US006672083B2

(12) United States Patent
Mildengren

(10) Patent No.: US 6,672,083 B2
(45) Date of Patent: Jan. 6, 2004

(54) INTEGRATED MINI ICE SHEETS

(76) Inventor: Steve Mildengren, 727 Calle Corta, Thousand Oaks, CA (US) 91360

( * ) Notice: Subject to any disclaimer, the term of this patent is extended or adjusted under 35 U.S.C. 154(b) by 0 days.

(21) Appl. No.: 10/171,350

(22) Filed: Jun. 12, 2002

(65) Prior Publication Data

US 2003/0014991 A1 Jan. 23, 2003

Related U.S. Application Data

(60) Provisional application No. 60/307,061, filed on Jul. 18, 2002.

(51) Int. Cl.[7] ..... F25D 17/06
(52) U.S. Cl. ..... 62/93; 62/235
(58) Field of Search ..... 62/235, 93; 472/92

(56) References Cited

U.S. PATENT DOCUMENTS

| | | | | | |
|---|---|---|---|---|---|
| 2,225,207 | A | * | 12/1940 | Cluff | 62/93 |
| 3,495,415 | A | | 2/1970 | MacCracken | |
| 3,641,782 | A | * | 2/1972 | Timms | 62/235 |
| 3,658,124 | A | * | 4/1972 | Tippmann | 62/235 |
| 3,808,831 | A | * | 5/1974 | Landry | 62/235 |
| 3,910,059 | A | * | 10/1975 | MacCracken | 62/235 |
| 3,990,260 | A | * | 11/1976 | Eustis | 62/235 |
| 4,038,834 | A | | 8/1977 | Roberts | |
| 4,497,483 | A | | 2/1985 | Ahlgren | |
| 4,513,583 | A | * | 4/1985 | Watt | 62/235 |
| 4,667,481 | A | * | 5/1987 | Watanabe et al. | 62/235 |
| 5,027,613 | A | * | 7/1991 | Pare | 62/235 |
| 5,134,857 | A | * | 8/1992 | Burley | 62/235 |
| 5,331,826 | A | | 7/1994 | Stockhaus | |
| 5,771,706 | A | | 6/1998 | Lavigne | |
| 5,897,438 | A | * | 4/1999 | Kunz et al. | 62/235 |
| 6,089,035 | A | | 7/2000 | Mildengren | |
| 6,126,551 | A | * | 10/2000 | Martin | 62/235 |
| 6,321,551 | B1 | * | 11/2001 | Backman et al. | 62/235 |

* cited by examiner

*Primary Examiner*—William E. Tapolcai
*Assistant Examiner*—Mohammad M. Ali

(57) ABSTRACT

Integrated mini ice sheets comprise an ice skating surface. At least one divider is disposed upon the skating surface for dividing the ice skating surface into a plurality of skating areas. The divider comprises one or more panels, optionally joined, and additionally comprises common or separate air conditioning means, optionally ducted, optionally integrated with the divider, for providing chilled dried air over the ice skating surface in each skating environment created in the skating areas separated by the divider.

20 Claims, 4 Drawing Sheets

INTEGRATED MINI ICE SHEETS

This continuation-in-part application claims the benefit of prior copending U.S. application Ser. No. 60/307,061, filed Jul. 18, 2002, which is incorporated herein by reference.

BACKGROUND OF THE INVENTION

1. Field of the Invention

The present invention relates to skating rinks for recreation and ice-hockey, more particularly to practice skating rinks for training, and especially to subdivided skating rinks for reducing interference between the activities of individuals.

2. Description of the Related Art

Historically, ice hockey practice and skills instruction have been conducted over the entire surface of a full size ice rink or ice arena or an open but not completely confined portion of the ice surface.

The difficulties encountered in the use of a full size ice rink or arena include the sizable expense to purchase time and space on the ice surface; problems in attempting to schedule the use of a portion of the ice surface for practice and skills instruction due to the need to have the full ice surface available for public use or skating lessons during specified times during the day and night; the difficulty in physically cordoning off a section of the ice surface which would be used for individualized practice and instruction in which a goal net would be situated; the inability of the upright surrounding border of the ice surface which is in place (referred to as boards) to confine the multitude of ice hockey pucks shot for quick and easy retrieval to be used over and over again; the possibility of interfering with or striking another person on the ice surface with an errant ice hockey puck shot or ricochet; and the inability to be focused on the task at hand due to the open nature of the setting and the passive or overt actions of others in close proximity to the participants.

SUMMARY OF THE INVENTION

It is an object of the present invention to subdivide an ice skating rink into miniature rink areas for conducting simultaneous independent activities.

It is an additional object of the present invention to prevent interference and injuries during practice sessions in figure-skating and ice-hockey by separating activities or separating individuals.

It is an additional object of the present invention to confine hockey pucks to a space where they are easily collected.

Additional objects of the present invention are to allow individuals engaged in independent skating activities to remain near to one another and to maintain atmospheric conditions which are appropriate for preserving the ice skating surface and which minimize any health risks associated with the inhalation of fog and with the confinement of people and the operation of air-handling equipment in a humid indoor environment.

In accordance with these objects and with others which will be described and which will become apparent, an exemplary embodiment of integrated mini ice sheets in accordance with the present invention comprises an ice skating surface and a divider, disposed upon the skating surface, for dividing the ice skating surface into a plurality of skating areas. The divider may comprise a plurality of panels which may optionally be joined by a zipper or other fastener system. The present invention additionally comprises air conditioning means, optionally single or multiple, optionally ducted, for providing chilled dried air over the ice skating surface in each skating environment created in the skating areas separated by the divider.

Alternatively, an embodiment of the present invention comprises only a divider and air conditioning means, to be provided together at a pre-existing ice skating facility.

It is an advantage of the present invention that skaters who, for example, wish only to take practice-shots at a hockey goal, can practice in a portion of a skating rink and thereby can avoid the expense of purchasing time on the whole rink, while rink operators can schedule multiple simultaneous activities in separated portions the rink.

It is an additional advantage of the present invention that activities which might be incompatible in a shared skating space may simultaneously be conducted without mutual interference: a hockey player can take shots at a goalie with full force in one area, while a figure skater can practice jumps and spins in another, each without fear of injuring the other.

Additional advantages of the present invention include the confinement of activities to a small area in order, for example, to intensify a training exercise, and the confinement of hockey pucks for efficient retrieval during practice.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 1:
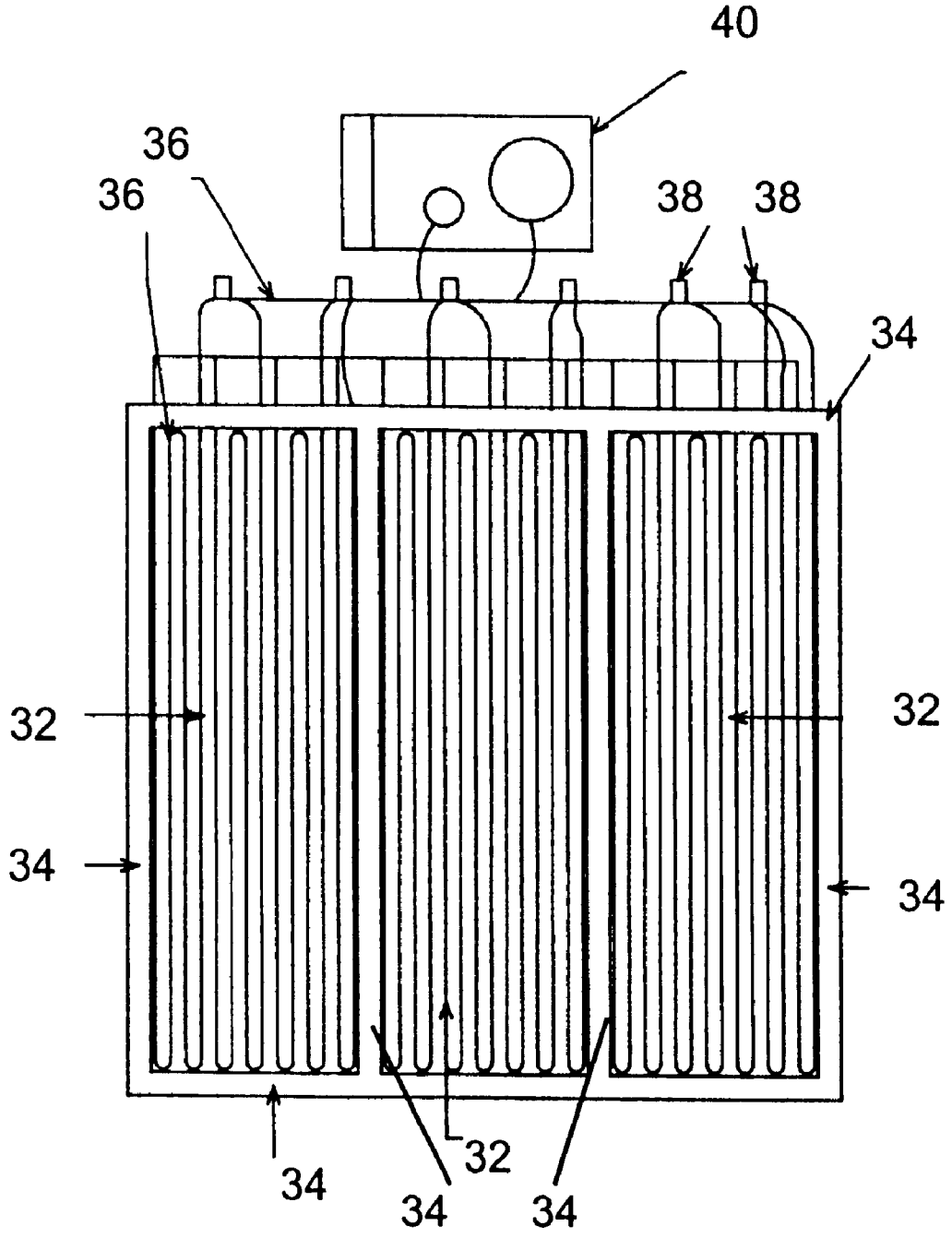
FIG. 1 depicts an overhead view of an exemplary embodiment of an integrated mini ice rink area in accordance with the present invention having three areas.

The present invention will now be described with reference to FIG. 1, which shows a top view of a group of integrated mini ice sheets 30 in accordance with the present invention, comprising ice sheets 32 separated from one another by walls 34. The ice sheets 32 are chilled by coils 36 which are connected by thermostatic expansion valves 38 to a compressor 40 which is rated at approximately 6 hp per ice sheet 32.

Figure 2:
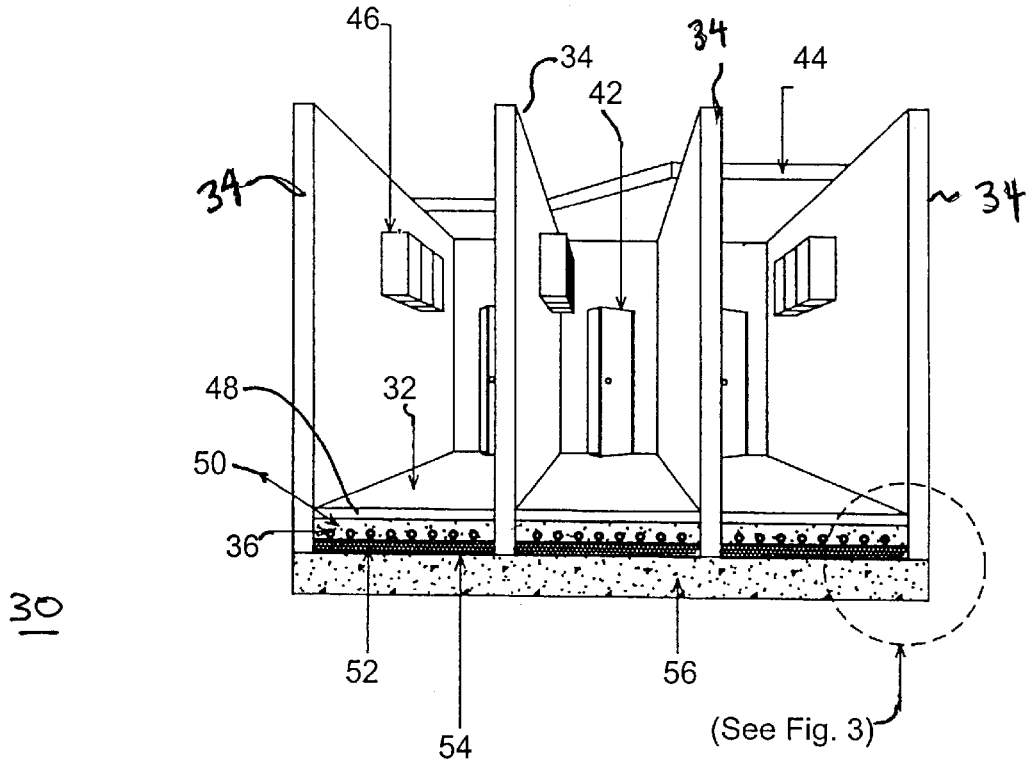
FIG. 2 depicts a side sectional perspective view of the embodiment of FIG. 1.
Figure 3:
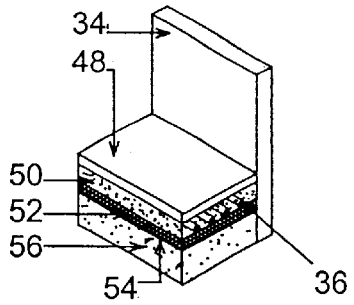
FIG. 3 depicts a perspective sectional view of a portion of the embodiment of FIG. 1.

FIGS. 2 and 3 show a side perspective view of a group of integrated mini ice sheets in accordance with the present invention, indicated generally by the reference number 30, comprising ice sheets 32 separated from one another by walls 34. Each ice sheet 32 comprises a layer of ice 48 chilled by coils 36 which are embedded in a layer of sand 50 beneath which are layers of insulation 52, polymeric liner 54 and concrete 56. The walls 34 are outfitted with doors 42.

Dehumidifiers 46 are located on the walls 34. A roof 44 is located above the walls 34.

Figure 4:
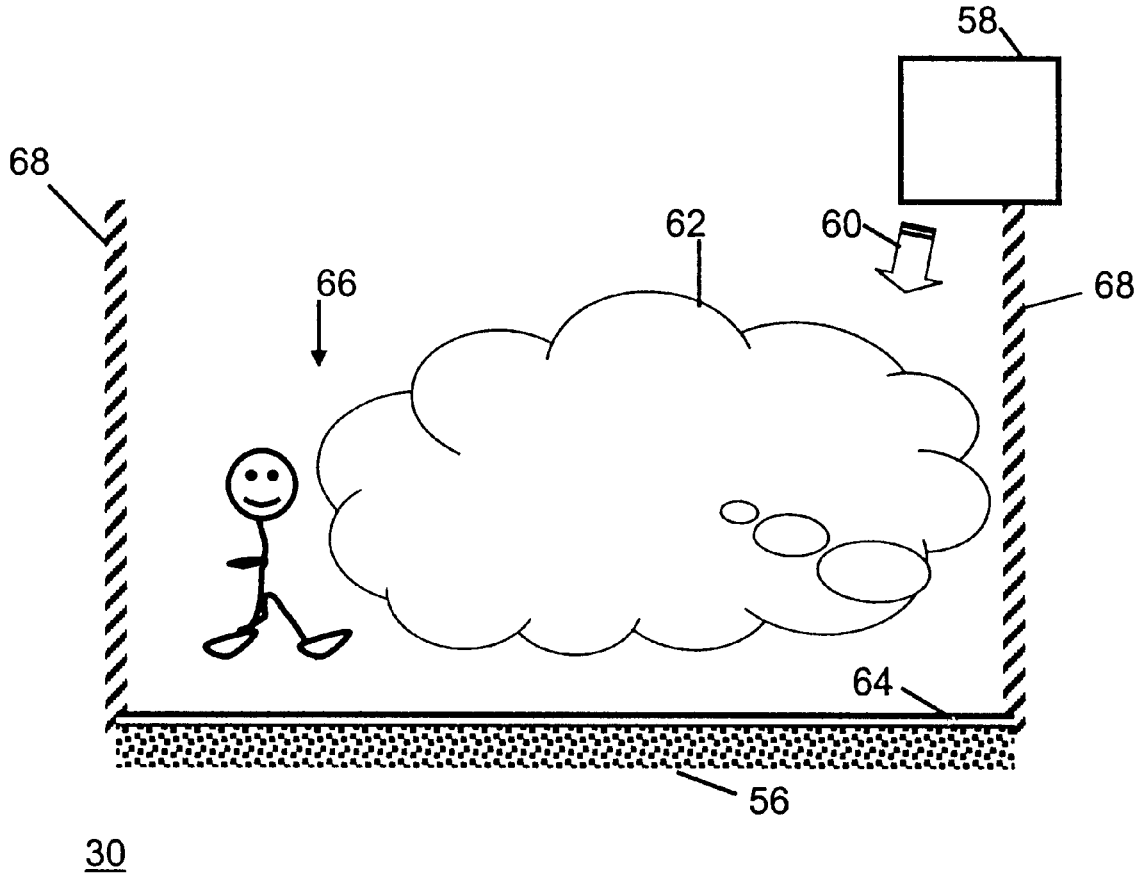
FIG. 4 is a side sectional view of an exemplary embodiment of a single ice sheet in accordance with the present invention.

FIG. 4 shows a side view of an integrated mini ice sheet in accordance with the present invention, indicated generally by the reference number 30, comprising an ice sheet 32 bounded by divider panels 68. A divider panel 68 supports air conditioning means 58 which provide air discharge 60 for maintaining chilled dried air 62 adjacent the skating area surface 64 of the ice sheet 32. For simplicity, FIG. 4 does not show the concrete, liner, insulation, sand, or coils.

Figure 5:
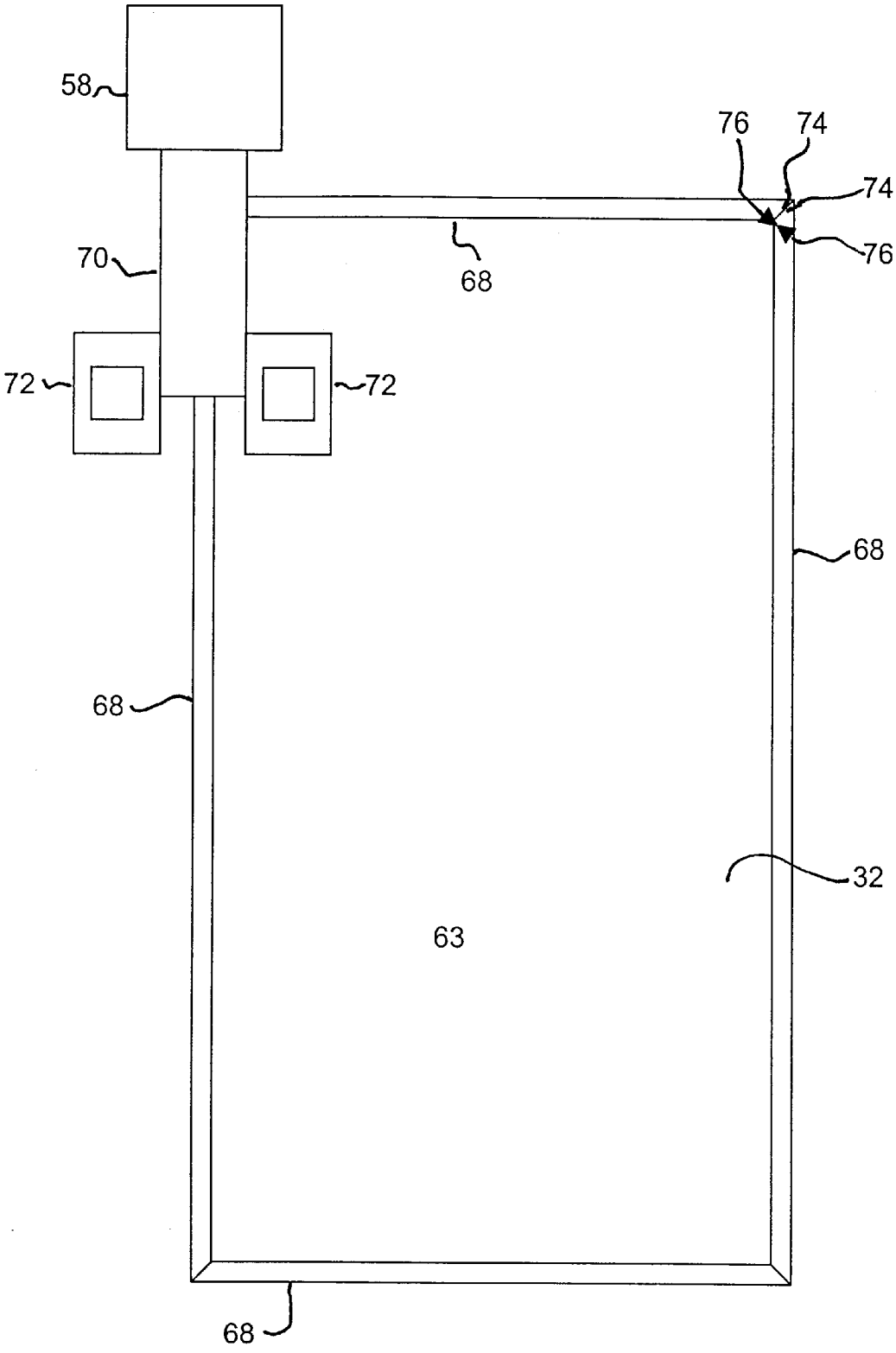
FIG. 5 is a top view of an alternative embiodiment of a single ice sheet in accordance with the present invention.

FIG. 5 shows a top view of an integrated mini ice sheet in accordance with the present invention, indicated generally by the reference number 30, comprising an ice sheet 32 bounded by divider panels 68. A divider panel 68 supports air conditioning means 58 which provides air through duct 70 and vents 72 to the skating environment 66 and to an adjacent skating environment 78.

With continued reference to FIG. 5, the divider panels form edges 74 which are equipped with zippers 76 which function to join the edges 74 to enclose a skating environment 66.

With reference to FIGS. 1, 2, 3, 4, and 5 and with reference to the disclosure of U.S. Pat. Nos. 6,089,035, 3,495,415, 4,038,834, 4,497,483, 5,331,826, and 5,771,706, the disclosures of which are incorporated herein by reference, the divider panels 68 may be rigid or flexible, may be made of any suitable material such as wood, fiberglass, metal, or fabric.

It will be appreciated that chilled dried air will tend to sink relative to ambient air, resulting in stratification of the air in a skating environment 66 or the displacement of ambient air from a skating environment 66; that a substantially continuous enclosure created by one or more divider panels 68 in accordance with the present invention will tend to confine such stratified air and to protect it from displacement or disturbance by wind; and that after first filling up the lower portions of an enclosed skating environment 66 the chilled dried air will displace the remaining warmer, more humid air, ultimately spilling over into any accessible adjacent skating environment 66 if supplied in sufficient volume and at sufficient pressure by an air cooling and drying apparatus.

It will also be appreciated that, while the prevention of condensation of moisture on the ice skating surface might only require the displacement of a shallow layer of moist air by drier air, the health of skaters might better be protected by drying substantially all of the air in a skating environment 66.

Thus, in accordance with the present invention, certain embodiments provide a plurality of air conditioning means 58, one for each skating environment 66. Alternative embodiments provide a duct 70 for delivering air through vents 72 to a plurality of skating environments 66 from a single air conditioning means 58.

The pressure, flow rate, duct exit velocity, and duct positioning are adjusted to provide for a stratified layer of chilled dried air 62 or, if such is not preferred, to chill and dry the entire air volume of each skating environment 66.

While the foregoing detailed description has described several embodiments of integrated mini ice sheets in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention. The present invention, therefore, is to be limited only by the claims.

What is claimed is:

1. An integrated mini ice sheet comprising:

an ice skating surface;

at least one divider disposed on said ice skating surface;

at least one divider defining individual skating areas and individual skating environments on said ice skating surface and within said individual skating areas; and air conditioning means disposed proximate said at least one divider for providing a volume of chilled dried air within each of said skating environments;

whereby said ice skating surface is preserved and unhealthy humidity is prevented in each of said skating environments.

2. An integrated mini ice sheet as set forth in claim 1, wherein said ice skating surface is part of a combination including a bottom layer of concrete surrounded by a rigid free standing border, layers of thermal insulation, plastic sheeting, sand, and freezing pipes resting on said layer of concrete, said freezing pipes being adapted to be connected to a refrigeration system; said surface being created from a layer of water which has been frozen by said refrigeration system into sheets of ice to create ice surfaces suitable for skating thereon.

3. An integrated mini ice sheet as set forth in claim 1, wherein said at least one divider comprises a plurality of interconnected panels.

4. An integrated mini ice sheet as set forth in claim 2, wherein said at least one divider comprises a panel anchored to said layer of concrete.

5. An integrated mini ice sheet as set forth in claim 1, wherein said at least one divider comprises a panel movably disposed upon said ice skating surface.

6. An integrated mini ice sheet as set forth in claim 2, wherein said at least one divider comprises a plurality of panels anchored in said layer of concrete.

7. An integrated mini ice sheet as set forth in claim 1, wherein said at least one divider comprises a plurality of panels movably disposed upon said ice skating surface.

8. An integrated mini ice sheet as set forth in claim 1, including more than one divider forming a plurality of air-confining enclosures about respective ones of said skating areas, each of said air-confining enclosures substantially confining a respective one of said volumes of chilled dried air over each of said respective ones of said skating areas within said respective ones of said skating environments.

9. An integrated mini ice sheet as set forth in claim 1, comprising separate air conditioning means to maintain a volume of chilled dried air within each of said skating environments.

10. An integrated mini ice sheet as set forth in claim 1, wherein said at least one divider comprises a plurality of panels movably disposed on said ice skating surface, each one of said plurality of panels being fastenable to at least one other of said plurality of panels.

11. An integrated mini ice sheet as set forth in claim 10, wherein a zipper joins adjacent ones of said plurality of panels.

12. An integrated mini ice sheet as set forth in claim 1, further including duct means, wherein said air conditioning means maintains a plurality of volumes of chilled dried air within respective ones of said skating environments via at least one duct.

13. An integrated mini ice sheet as set forth in claim 1, further comprising a ceiling surface disposed over said at least one divider, said ceiling surface and said at least one divider substantially confining a respective one of said volumes of chilled dried air within each of said respective ones of said plurality of skating environments.

14. An integrated mini ice sheet as set forth in claim 12, wherein said at least one divider supports said duct.

15. An integrated mini ice sheet as set forth in claim 12, wherein said at least one divider encloses said duct.

16. A method of providing an individual skating environment, the method comprising the steps of;

providing an ice skating surface comprised of at least one divider disposed on said ice skating surface and air conditioning means disposed proximate said at least one divider; enclosing at least one individual skating area on said ice skating surface, the individual skating area defining an individual skating environment;

and whereby said ice skating surface is preserved and unhealthy humidity is prevented in said skating environment.

17. A method as set forth in claim 16, wherein said step of dividing said ice skating surface includes the steps of placing a divider panel on said ice skating surface, said divider panel having first and second ends, and approximating said second end to said first end to enclose said individual skating area and to define an individual skating environment thereabove.

18. A method as set forth in claim 17, wherein the step of providing dried chilled air includes the steps of placing a duct atop said divider panel and introducing dried chilled air through said duct into said individual skating environment.

19. A method as set forth in claim 17, wherein said first and second ends of said divider panel comprise a zipper closure, further including the step of joining said first and second ends by means of said zipper closure.

20. A method as set forth in claim 18, wherein said duct is configured to simultaneously discharge chilled dried air to both sides of said divider panel.

* * * * *